US006652609B1

(12) United States Patent
Caprotti

(10) Patent No.: US 6,652,609 B1
(45) **Date of Patent: *Nov. 25, 2003**

(54) FUEL OIL COMPOSITIONS

(75) Inventor: Rinaldo Caprotti, Oxfordshire (GB)

(73) Assignee: Exxon Chemical Patents Inc

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 28 days.

(21) Appl. No.: 09/111,653

(22) Filed: Jul. 8, 1998

(30) Foreign Application Priority Data

Jul. 15, 1997 (GB) ..... 9714828

(51) Int. Cl.[7] ..... C10L 1/18; C10L 1/24

(52) U.S. Cl. ..... 44/370; 44/385; 44/403; 44/435; 44/450; 44/457

(58) Field of Search ..... 44/370, 400, 388, 44/385, 403, 435, 450, 452

(56) References Cited

U.S. PATENT DOCUMENTS

| | | | | |
|---|---|---|---|---|
| 2,626,207 A | | 1/1953 | Wies et al. | |
| 2,672,408 A | * | 3/1954 | Bonner | 44/370 |
| 2,764,548 A | | 9/1956 | King et al. | |
| 2,866,694 A | * | 12/1958 | Glendenning et al. | 44/370 |
| 2,950,960 A | * | 8/1960 | Barusch et al. | 44/370 |
| 3,446,736 A | * | 5/1969 | Herd et al. | 44/373 |
| 3,539,312 A | * | 11/1970 | Eckert et al. | 44/373 |
| 3,637,356 A | | 1/1972 | Vanderlinden et al. | |
| 5,160,350 A | * | 11/1992 | Stoldt | 44/370 |

FOREIGN PATENT DOCUMENTS

| | | |
|---|---|---|
| EP | 022110 | 1/1981 |
| EP | 049976 | 4/1982 |
| EP | 0 192 323 | 8/1986 |
| EP | 319059 | 6/1989 |
| EP | 0 319 059 | 6/1989 |
| GB | 888 325 | 1/1962 |
| GB | 914 777 | 1/1963 |
| GB | 1 090 289 | 11/1967 |
| GB | 1 246 545 | 9/1971 |
| GB | 2091291 | 7/1982 |
| GB | 2 091 291 | 7/1982 |
| JP | 520037907 | 3/1977 |
| JP | 540081536 | 6/1979 |
| JP | 591008096 | 6/1984 |
| SU | 667579 | 6/1979 |
| SU | 722938 | 3/1980 |
| SU | 973595 | 11/1982 |
| WO | WO 86 00302 | 1/1986 |
| WO | WO 89 07126 | 8/1989 |

* cited by examiner

*Primary Examiner*—Margaret Medley

(57) ABSTRACT

This invention relates to fuel oil, especially middle distillate fuel oil, compositions comprising middle distillate fuel oil and at least one fuel-soluble or fuel dispersible calcium and/or magnesium salt.

4 Claims, No Drawings

FUEL OIL COMPOSITIONS

This invention relates to fuel oil, especially middle distillate fuel oil, compositions of improved combustion performance, particularly demonstrating reduced particulate matter emission and/or smoke. This invention is especially directed to hydrocarbon middle distillate fuel oil compositions.

Certain organometallic compounds are known to be effective combustion improvers for distillate fuels such as home heating oils. For example, U.S. Pat. No. 3,112,789 describes the use of cyclopentadienyl manganese tricarbonyls for this purpose.

EP-B-0 476 196 describes an additive composition for hydrocarbonaceous fuel comprising (a) one or more fuel-soluble manganese carbonyl compounds;

(b) one or more fuel-soluble alkali or alkaline earth metal containing detergents; and (c) one or more fuel-soluble ashless dispersants;

and its use for reducing the soot, smoke and/or carbonaceous products produced on combustion of the fuel and for reducing the acidity of the carbonaceous products.

U.S. Pat. No. 3,883,320 discloses jet engine fuels comprising an oil-soluble transition metal compound, an oil-soluble compound of a secondary metal selected from the alkaline earths and an oil-soluble ammonium salt for inhibiting the formation of visible smoke and minimising the deposition of ash on jet engine parts.

Canadian Patent No. 1,188,891 describes an additive comprising at least one oil-soluble and/or dispersible compound of a transition metal and/or alkaline earth metal as well as one of several inhibitors against polymerisation and oxidation of hydrocarbons which inhibits the formation of soot. Examples 1 and 2 disclose compositions containing overbased (carbonated) barium sulphonate.

EP-B-0 022 110 describes an emulsifier containing a mixture of a non-ionic surface active ethylene oxide adduct and calcium dodecylbenzene sulphonate and its use for the manufacture of an emulsion of water in mineral oil.

GB-A-2 091 291 discloses an additive for a diesel fuel oil, which comprises on oil soluble or dispersible calcium compound and an oil soluble or dispersible iron compound, for smoke suppression.

U.S. Pat. No. 3,539,312 discloses a hydrocarbon light distillate fuel oil composition containing minor amounts of calcium sulfonate and an overbasing component represented by the formula:

$$Ca[O(R^1O)yR]z$$

in which R represents nil, hydrogen, or an alkyl radical having from 1 to 10 carbons atoms, $R^1$ is an alkylene radical having from 2 to 4 carbon atoms, y has a value from 0 to 4, z has a value of 1 when R is nil, and z has a value of 2 when R is H or alkyl. Such fuel compositions are discussed in relation to reduction in smoke emissions.

There is, however, a continuing need for fuel oils which on combustion produce lower levels of particulate matter; this is especially important for the middle-distillate fuels, such as diesel fuels and heating oils.

Further, there is an on-going demand to minimise the cost of additives used, and reduce the amount and range of metals used in fuel oils, for example, in order to reduce the formation of ash deposits upon combustion, or in order to preserve metals for other uses.

The present invention meets this need by providing a hydrocarbon middle distillate fuel composition comprising middle distillate fuel oil and at least one fuel-soluble neutral calcium and/or magnesium salt. It has been surprisingly found that such fuel compositions produce a lower amount of particulate matter on combustion.

Accordingly, a first aspect of the present invention is a hydrocarbon middle distillate fuel composition free of transition metal compounds comprising middle distillate fuel oil and at least one fuel-soluble or fuel-dispersible neutral calcium and/or magnesium salt of sulphonic acid, phenol, sulphurised phenol, salicylic acid or carboxylic acid wherein the sulphonic acid contains at least 22 carbon atoms.

A second aspect of the present invention is the use of at least one fuel-soluble or fuel-dispersible neutral calcium and/or magnesium salt of sulphonic acid, phenol, sulphurised phenol, salicylic acid or carboxylic acid, in fuel oil, which is preferably free of transition metal compounds, to reduce particulate emissions during combustion of the fuel oil.

A third aspect of the present invention is a method for reducing particulate emissions during operation of a fuel oil combustion device comprising addition to the fuel oil, which is preferably free of transition metal compounds, used therein of at least one fuel-soluble or fuel-dispersible neutral calcium and/or magnesium salt of sulphonic acid, phenol, sulphurised phenol, salicylic acid or carboxylic acid.

Hydrocarbon Middle Distillate Fuel Oil

The term 'hydrocarbon middle distillate fuel composition' as used herein refers to middle distillate fuel oils which are substantially free, and preferably free, of ethers and/or alcohols. As used herein the term 'substantially free' with reference to ethers and/or alcohols in fuel oil refers to an amount of up to 20 mass % based on the mass of the middle distillate fuel oil, preferably up to 10 mass %, more preferably up to 5 mass %.

The use of transition metal compounds can be avoided in the present invention and such metals may be preserved for other uses if desired. Examples of transition metal compounds are compounds of the metals manganese, iron, cobalt, nickel, copper, zinc and molybdenum. In particular, use of manganese and iron compounds may be avoided, especially manganese carbonyl compounds, ferrocene or iron naphthenate.

Middle distillate fuel oils generally boil within the range of about 100° C. to about 500° C., e.g. 150° to about 400° C., for example, those having a relatively high Final Boiling Point of above 360° C. (ASTM D-86). Middle distillates contain a spread of hydrocarbons boiling over a temperature range, including n-alkanes which precipitate as wax as the fuel cools. They may be characterised by the temperatures at which various %'s of fuel have vaporised, e.g. 10% to 90%, being the interim temperatures at which a certain volume % of initial fuel has distilled. The difference between say 90% and 20% distillation temperature may be significant. They are also characterised by pour, cloud and CFPP points, as well as their initial boiling point (IBP) and final boiling point (FBP). The petroleum fuel oil can comprise atmospheric distillate or vacuum distillate, or cracked gas oil or a blend in any proportion of straight run and thermally and/or catalytically cracked distillates. The most common middle distillate fuels are jet fuels, diesel fuels and heating oils. The heating oil may be a straight atmospheric distillate, or it may contain minor amounts, e.g. up to 35 mass %, of vacuum gas oil or cracked gas oils or of both.

Heating oils may be made of a blend of virgin distillate, e.g. gas oil, naphtha, etc. and cracked distillates, e.g. catalytic cycle shock. A representative specification for a diesel fuel includes a minimum flash point of 38° C. and a 90% distillation point between 282 and 380° C. (see ASTM Designations D-396 and D-975).

The fuel oil may also be an animal or vegetable oil, or a mineral oil as described above in combination with an animal or vegetable oil. Fuels from animal or vegetable sources are known as biofuels and are believed to be less damaging to the environment on combustion, and are obtained from a renewable source. It has been reported that on combustion less carbon dioxide is formed than is formed by the equivalent quantity of petroleum distillate fuel, e.g. diesel fuel, and very little sulphur dioxide is formed. Certain derivatives of vegetable oil, for example rapeseed oil, e.g. those obtained by saponification and re-esterification with a monohydric alcohol, may be used as a substitute for diesel fuel. It has recently been reported that mixtures of a rapeseed ester, for example, rapeseed methyl ester (RME), with petroleum distillate fuels in ratios of, for example, 10:90 by volume are likely to be commercially available in the near future.

Thus, a biofuel is a vegetable or animal oil or both or a derivative thereof, particularly an oil comprising fatty acid and/or fatty acid esters.

Vegetable oils are mainly tricylcerides of monocarboxylic acids, e.g. acids containing 10–25 carbon atoms and listed below

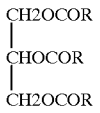

where R is an aliphatic radical of 10–25 carbon atoms which may be saturated or unsaturated.

Generally, such oils contain glycerides of a number of acids, the number and kind varying with the source vegetable of the oil.

Examples of oils are rapeseed oil, coriander oil, soyabean oil, cottonseed oil, sunflower oil, castor oil, olive oil, peanut oil, maize oil, almond oil, palm kernel oil, coconut oil, mustard seed oil, beef tallow and fish oils. Rapeseed oil, which is a mixture of fatty acids partially esterified with glycerol, is preferred as it is available in large quantities and can be obtained in a simple way by pressing from rapeseed.

Examples of derivatives thereof are alkyl esters, such as methyl esters, of fatty acids of the vegetable or animal oils. Such esters can be made by transesterification.

As lower alkyl esters of fatty acids, consideration may be given to the following, for example as commercial mixtures: the ethyl, propyl, butyl and especially methyl esters of fatty acids with 12 to 22 carbon atoms, for example of lauric acid, myristic acid, palmitic acid, palmitoleic acid, stearic acid, oleic acid, elaidic acid, petroselic acid, ricinoleic acid, elaecostearic acid, linoleic acid, linolenic acid, eicosanoic acid, gadoleic acid, docosanoic acid or erucic acid, which have an iodine number from 50 to 150, especially 90 to 125. Mixtures with particularly advantageous properties are those which contain mainly, i.e. to at least 50 mass % methyl esters of fatty acids with 16 to 22 carbon atoms and 1, 2 or 3 double bonds. The preferred lower alkyl esters of fatty acids are the methyl esters of oleic acid, linoleic acid, linolenic acid and erucic acid.

Commercial mixtures of the stated kind are obtained for example by cleavage and esterification of natural fats and oils by their transesterification with lower aliphatic alcohols. For production of lower alkyl esters of fatty acids it is advantageous to start from fats and oils with high iodine number, such as, for example, sunflower oil, rapeseed oil, coriander oil, castor oil, soyabean oil, cottonseed oil, peanut oil or beef tallow. Lower alkyl esters of fatty acids based on a new variety of rapeseed oil, the fatty acid component of which is derived to more than 80 mass % from unsaturated fatty acids with 18 carbon atoms, are preferred.

Preferably the biofuel is present in an amount of up to 50 mass % based on the mass of the middle distillate fuel oil, more preferably of up to 10 mass %, especially up to 5 mass %.

Also, the fuel oil preferably has a sulphur concentration of 0.2% by mass or less based on the mass of the fuel. Preferably, the sulphur concentration is 0.05% by mass or less, more preferably 0.03% by mass or less, especially 0.01% by mass or less. The art describes methods for reducing the sulphur concentration of hydrocarbon middle distillate fuels, such methods including solvent extraction, sulphuric acid treatment, and hydrodesulphurisation. Fuel oils having such low sulphur levels show good response to the neutral salts of the present invention despite the reduced tendency of such fuels to produce particulate emissions.

Preferably the hydrocarbon middle distillate fuel oil is diesel fuel or heating oil.

Fuel-Soluble or Fuel-Dispersible Neutral Calcium and/or Magnesium Salt

The term 'neutral' as used herein refers to metal salts that are predominantly neutral in character, that is most of the metal is associated with the surfactant anion. For a metal salt to be completely neutral, the total number of moles of the metal cation to the total number of moles of surfactant anion associated with the metal will be stoichiometric. For example, for every one mole of calcium cations there should be two moles of sulphonate anions.

The metal salts of the present invention include predominantly neutral salts where minor amounts of non-surfactant anions, such as carbonate and/or hydroxide, succinate may also be present provided their presence does not alter the predominantly neutral character of the metal salt.

Thus, metal salts of the present invention preferably have a metal ratio of less than 2, more preferably less than 1.95, especially less than 1.9, advantageously less than 1.8, more especially less than 1.6, for example less than 1.5, such as less than 1.4 or less than 1.35. The metal ratio is preferably at least about 1.0. The metal ratio, as used herein, is the ratio of total metal to the metal associated with the surfactant. So metal salts having a metal ratio of less than 2 have greater than 50% of the metal associated with the surfactant anion.

Any type of surfactant may be used in the present invention. Examples of suitable surfactants are sulphonic acids, phenol, sulphurised phenol, salicylic acid and carboxylic acid.

The metal ratio can be calculated by a) measuring the total amount of metal in the neutral metal salt; and then b) determining the amount of metal associated with the surfactant.

Suitable methods for measuring the total metal content are well known in the art and include X-ray fluorescence and atomic absorption spectrometry.

Suitable methods for determining the amount of metal associated with the surfactant include potentiometric acid titration of the metal salt to determine the relative proportions of the different basic constituents (for example, metal carbonate and metal surfactant); hydrolysis of a known amount of metal salt then the potentiometric base titration of the organic surfactant to determine the equivalent moles of surfactant; and determination of the non-surfactant anions, such as carbonate, by measuring the $CO_2$ content.

In the case of a metal sulphonate, ASTM D3712 may be used to determine the metal associated with the sulphonate.

In the instance where a composition comprises neutral metal salt and one or more co-additives, then the neutral metal salt(s) may be separated from the co-additives, for example, by using dialysis techniques and then the neutral metal salt may be analysed as described above to determine the metal ratio. Background information on suitable dialysis techniques is given by Amos, R. and Albaugh, E. W. in "Chromatography in Petroleum Analysis") Altgelt, K. H. and Gouw, T. H., Eds., pages 417 to 421, Marcel Dekker Inc., New York and Basel, 1979.

The neutral salts of the present invention may be salts of one type of surfactant or salts of more than one type of surfactant. Preferably, they are salts of one type of surfactant.

Sulphonic acids used in accordance with this aspect of the invention are typically obtained by sulphonation of hydrocarbyl-substituted, especially alkyl-substituted, aromatic hydrocarbons, for example, those obtained from the fractionation of petroleum by distillation and/or extraction, or by the alkylation of aromatic hydrocarbons. Examples include those obtained by alkylating benzene, toluene, xylene, naphthalene, biphenyl or their halogen derivatives, for example, chlorobenzene, chlorotoluene or chloronaphthalene. Alkylation of aromatic hydrocarbons may be carried out in the presence of a catalyst with alkylating agents having from about 3 to more than 100 carbon atoms, such as, for example, haloparaffins, olefins that may be obtained by dehydrogenation of paraffms, and polyolefms, for example, polymers of ethylene, propylene, and/or butene. The alkylaryl sulphonic acids usually contain from about 22 to about 100 or more carbon atoms; preferably the alkylaryl sulphonic acids contain at least 26 carbon atoms, especially at least 28, such as at least 30, carbon atoms. The sulphonic acids may be substituted by more than one alkyl group on the aromatic moiety, for example they may be dialkylaryl sulphonic acids. The alkyl group preferably contains from about 16 to about 80 carbon atoms, with an average number of carbon atoms in the range of from 36–40, or an average carbon number of 24, depending on the source from which the alkyl group is obtained. Preferably the sulphonic acid has a number average molecular weight of 350 or greater, more preferably 400 or greater, especially 500 or greater, such as 600 or greater. Number average molecular weight may be determined by ASTM D3712.

When neutralising these alkylaryl sulphonic acids to provide sulphonates, hydrocarbon solvents and/or diluent oils may also be included in the reaction mixture, as well as promoters.

Another type of sulphonic acid which may be used in accordance with the invention comprises alkyl phenol sulphonic acids. Such sulphonic acids can be sulphurized. Preferred substituents in alkyl phenol sulphonic acids are substituents represented by R in the discussion of phenols below.

Sulphonic acids suitable for use in accordance with the invention also include alkyl sulphonic acids. In such compounds the sulphonic acid suitably contains 22 to 100 carbon atoms, advantageously 25 to 80 carbon atoms, especially 30 to 60 carbon atoms.

Preferably the sulphonic acid is hydrocarbyl-substituted aromatic sulphonic acid, more preferably alkyl aryl sulphonic acid.

Phenols used in accordance with the invention may be non-sulphurized or, preferably, sulphurized. Further, the term "phenol" as used herein includes phenols containing more than one hydroxyl group (for example, alkyl catechols) or fused aromatic rings (for example, alkyl naphthols) and phenols which have been modified by chemical reaction, for example, alkylene-bridged phenols and Mannich base-condensed phenols; and saligenin-type phenols (produced by the reaction of a phenol and an aldehyde under basic conditions).

Preferred phenols from which neutral calcium and/or magnesium salts in accordance with the invention may be derived are of the formula

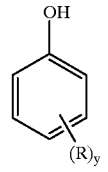

where R represents a hydrocarbyl group and y represents 1 to 4. Where y is greater than 1, the hydrocarbyl groups may be the same or different.

The phenols are frequently used in sulphurized form. Sulphurized hydrocarbyl phenols may typically be represented by the formula:

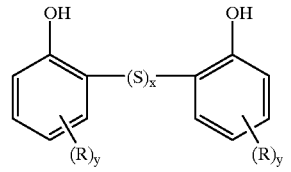

where x, represents an integer from 1 to 4. In some cases, more than two phenol molecules may be linked by $(S)_x$ bridges, where S represents a sulphur atom.

In the above formulae, hydrocarbyl groups represented by R are advantageously alkyl groups, which advantageously contain 5 to 100 carbon atoms, preferably 5 to 40 carbon atoms, especially 9 to 12 carbon atoms, the average number of carbon atoms in all of the R groups being at least about 9 in order to ensure adequate solubility in oil. Preferred alkyl groups are nonyl (e.g. tripropylene) groups or dodecyl (e.g. tetrapropylene) groups.

In the following discussion, hydrocarbyl-substituted phenols will for convenience be referred to as alkyl phenols.

A sulphurizing agent for use in preparing a sulphurized phenol or phenate may be any compound or element which introduces —$(S)_x$— bridging groups between the alkyl phenol monomer groups, wherein x is generally from 1 to about 4. Thus, the reaction may be conducted with elemental sulphur or a halide thereof, for example, sulphur dichloride or, more preferably, sulphur monochloride. If elemental sulphur is used, the sulphurization reaction may be effected by heating the alkyl phenol compound at from 50 to 250° C., and preferably at least 100° C. The use of elemental sulphur will typically yield a mixture of bridging groups —$(S)_x$— as described above. If a sulphur halide is used, the sulphurization reaction may be effected by treating the alkyl phenol at from −10° C. to 120° C., preferably at least 60° C. The reaction may be conducted in the presence of a suitable diluent. The diluent advantageously comprises a substantially inert organic diluent, for example mineral oil or an alkane. In any event, the reaction is conducted for a period of time sufficient to effect substantial reaction. It is generally preferred to employ from 0.1 to 5 moles of the alkyl phenol material per equivalent of sulphurizing agent.

Where elemental sulphur is used as the sulphurizing agent, it may be desirable to use a basic catalyst, for example, sodium hydroxide or an organic amine, preferably a heterocyclic amine (e.g., morpholine).

Details of sulphurization processes are well known to those skilled in the art, for example U.S. Pat. Nos. 4,228,022 and 4,309,293.

As indicated above, the term "phenol" as used herein includes phenols which have been modified by chemical reaction with, for example, an aldehyde, and Mannich base-condensed phenols.

Aldehydes with which phenols used in accordance with the invention may be modified include, for example, formaldehyde, propionaldehyde and butyraldehyde. The preferred aldehyde is formaldehyde. Aldehyde-modified phenols suitable for use in accordance with the present invention are described in, for example, U.S. Pat. No. 5,259,967.

Mannich base-condensed phenols are prepared by the reaction of a phenol, an aldehyde and an amine. Examples of suitable Mannich base-condensed phenols are described in GB-A-2 121 432.

In general, the phenols may include substituents other than those mentioned above. Examples of such substituents are methoxy groups and halogen atoms.

Salicylic acids used in accordance with the invention may be non-sulphurized or sulphurized, and may be chemically modified and/or contain additional substituents, for example, as discussed above for phenols. Processes similar to those for phenols may also be used for sulphurizing a hydrocarbyl-substituted salicylic acid, and are well known to those skilled in the art. Salicylic acids are typically prepared by the carboxylation, by the Kolbe-Schmitt process, of phenoxides, and in that case, will generally be obtained (normally in a diluent) in admixture with uncarboxylated phenol.

Preferred substituents in oil-soluble salicylic acids from which neutral calcium and/or magnesium salts in accordance with the invention may be derived are the substituents represented by R in the above discussion of phenols. In alkyl-substituted salicylic acids, the alkyl groups advantageously contain 5 to 100 carbon atoms, preferably 9 to 30 carbon atoms, especially 14 to 20 carbon atoms.

Carboxylic acids which may be used in accordance with the invention include mono- and dicarboxylic acids. Preferred monocarboxylic acids are those containing 8 to 30 carbon atoms, especially 8 to 24 carbon atoms. (Where this specification indicates the number of carbon atoms in a carboxylic acid, the carbon atom(s) in the carboxylic group (s) is/are included in that number.) Examples of monocarboxylic acids are iso-octanoic acid, stearic acid, oleic acid, palmitic acid and behenic acid. Iso-octanoic acid may, if desired, be used in the form of the mixture of C8 acid isomers sold by Exxon Chemical under the trade name "Cekanoic". Other suitable acids are those with tertiary substitution at the α-carbon atom and dicarboxylic acids with 2 or more carbon atoms separating the carboxylic groups. Further, dicarboxylic acids with more than 35 carbon atoms, for example, 36 to 100 carbon atoms, are also suitable. Unsaturated carboxylic acids can be sulphurized.

In the instance where more than one type of surfactant is present in the metal salt, the proportion of any one type of surfactant to another is not critical provided the neutral character of the metal is not altered.

It will be appreciated by one skilled in the art that a single type of surfactant may contain a mixture of surfactants of the same type. For example, a sulphonic acid surfactant may contain a mixture of sulphonic acids of varying molecular weights. Such a surfactant composition is considered as one type of surfactant.

As used in this specification the term "hydrocarbyl" refers to a group having a carbon atom directly attached to the rest of the molecule and having a hydrocarbon or predominantly hydrocarbon character. Examples include hydrocarbon groups, including aliphatic (e.g. alkyl or alkenyl), alicyclic (e.g. cycloalkyl or cycloalkenyl), aromatic, and alicyclic-substituted aromatic, and aromatic-substituted aliphatic and alicyclic groups. Aliphatic groups are advantageously saturated. These groups may contain non-hydrocarbon substituents provided their presence does not alter the predominantly hydrocarbon character of the group. Examples include keto, halo, hydroxy, nitro, cyano, alkoxy and acyl. If the hydrocarbyl group is substituted, a single (mono) substituent is preferred.

Examples of substituted hydrocarbyl groups include 2-hydroxyethyl, 3-hydroxypropyl, 4-hydroxybutyl, 2-ketopropyl, ethoxyethyl, and propoxypropyl. The groups may also or alternatively contain atoms other than carbon in a chain or ring otherwise composed of carbon atoms. Suitable hetero atoms include, for example, nitrogen, sulphur, and, preferably, oxygen.

The calcium and/or magnesium salt of the present invention may be present in an amount of from 0.1 to 100 ppm by mass of metal based on the mass of the fuel oil composition, preferably from 0.1 to 50 ppm; more preferably from 0.1 to 25 ppm, especially from 0.1 to 10 ppm, such as from 1 to 5 ppm. Whilst the salt is preferably fuel soluble to allow even distribution throughout the fuel, dispersible salts are also usable.

The neutral calcium and/or magnesium salts of the present invention are "fuel-soluble" or "fuel-dispersible" in the fuel oil but these do not mean that they are soluble, dissolvable, miscible or capable of being suspended in the fuel oil in all proportions. They do mean, however, that the salts of the present invention are, for instance, soluble or stable dispersible in the fuel oil to an extent sufficient to exert their intended effect in the environment in which the fuel oil composition is employed. Moreover, the additional incorporation of other additives such as those described hereinafter may affect the fuel solubility or dispersibility of the salts of the invention.

Concentrates comprising the calcium and/or magnesium salt of the present invention in admixture with a carrier liquid (e.g. as a solution or a dispersion) are convenient as a means for incorporating the calcium and/or magnesium salt into bulk oil such as distillate fuel, which incorporation may be done by methods known in the art. The concentrates may also contain other additives as required and preferably contain from 3 to 75 mass %, more preferably 3 to 60 mass %, most preferably 10 to 50 mass % of the additives preferably in solution in oil. Examples of carrier liquid are organic solvents including hydrocarbon solvents, for example petroleum fractions such as naphtha, kerosene, lubricating oil, diesel and heater oil; aromatic hydrocarbons such as aromatic fractions, e.g. those sold under the 'SOLVESSO' tradename; and paraffinic hydrocarbons such as hexane and pentane and isoparaffins. The carrier liquid must, of course, be selected having regard to its compatibility with the additives and with the fuel.

Accordingly another aspect of the inventions is a fuel oil concentrate free of transition metal compounds comprising at least one neutral calcium and/or magnesium salt as defined in the first aspect of the invention.

The calcium and/or magnesium salt of the present invention may be incorporated into bulk oil by other methods such as those known in the art. If co-additives are required, they may be incorporated into the bulk oil at the same time as the calcium and/or magnesium salt of the present invention or at a different time.

The calcium and/or magnesium salt of the present invention may be used singly or as mixtures. They may also be used in combination with one or more co-additives such as known in the art, for example the following: detergents, dispersants, antioxidants, corrosion inhibitors, dehazers, demulsifiers, metal deactivators, antifoaming agents, cetane improvers, cosolvents, package compatibilisers, and lubricity additives and antistatic additives.

In the instance where both calcium metal salt and magnesium metal salt are present in the fuel oil, the mass to mass ratio based on active ingredient of calcium metal salt to magnesium metal salt is from 10:1 to 1:10, preferably from 5:1 to 1:5, more preferably from 2:1 to 1:2, such 1:1.

In the instance where each of the neutral calcium and magensium salts of the invention are used, it should be appreciated that interaction may take place between the neutral calcium and magnesium salts after they have been mixed in the fuel oil, in either the process of mixing or any subsequent condition to which the composition is exposed, including the use of the composition in its working environment. Interactions may also take place when further auxiliary additives are added to the compositions of the invention or with components of fuel oil. Such interaction may include interaction which alters the chemical constitution of the additive. Thus for example the compositions of the invention include compositions in which interaction between any of the additives has occurred, as well as compositions in which no interaction has occurred between the components mixed in the fuel oil.

An aspect of the present invention is a hydrocarbon middle distillate fuel composition free of transition metal compounds comprising middle distillate fuel oil and, in admixture therewith, at least one fuel-soluble or fuel-dispersible neutral calcium and/or magnesium salt as defined in the first aspect of the invention.

It has been found that neutral calcium and/or magnesium salt of the present invention are effective in fuel compositions free of transition metal compounds. In particular fuel oils which comprise at least one fuel-soluble neutral calcium salt are particularly well suited to reducing particulate matter emission. In one preferred aspect of the present invention, at least one of the neutral metal salts is a salt of sulphonic acid. Preferably the neutral metal salt is calcium sulphonate and preferably has a Total Base Number (TBN), as measured according to ASTM D2896, of at most 50, more preferably at most 30, such as at most 20.

An advantage of the present invention is that the use of expensive transition metal compounds in fuel oils can be avoided whilst achieving effective particulate matter reduction. The amount of metal used in fuel oils may also be reduced.

In a further aspect of the invention, the neutral salts have been found to give effective lubricity enhancement of a fuel oil. Concern about fuel oil lubricity is growing due to the step-wise introduction of legislation limiting fuel sulphur content, changes in fuel manufacturing processes necessary to meet these lower sulphur levels (as low as 0.05% sulphur by weight, per weight of fuel) leading to a decrease in inherent lubricity and an increased requirement for additives to boost lubricity levels, such that the fuel injection system (and particularly the fuel injection pump) remains effectively lubricated and not subject to excess wear.

Treatment with the neutral salts at levels of up to 1000 ppm or higher, such as 0.1 ppm to 1000 ppm (mass of additive per mass of the total fuel) have proved effective to improve fuel lubricity, as measured in tests such as the HFRR (High Frequency Reciprocating Rig) test.

Thus, the present invention also provides the use of the salt as defined in the second aspect of the invention, to improve the lubricity of fuel oil having a sulphur content of less than 0.2% mass, per mass of fuel (and preferably of less than 0.05% mass, per mass of fuel). The invention also provides a method for improving the lubricity of such fuel oil, comprising the addition thereto of the salt.

The invention is further illustrated by way of examples only with reference to the following Examples.

EXAMPLES

The particulate matter emission performance of fuels comprising a calcium salt of the present invention was measured in the OM366 diesel engine run according to the testing procedure outlined herein. Also measured, for comparative purposes, were fuels which comprised either an overbased calcium salt or ferrocene.

Examples 1–8 (see Table 1) were prepared by adding the specified metal compounds at the specified treat-rates to diesel fuel X. The properties of diesel fuel X are described below.

| Diesel fuel X: | Test Method | |
|---|---|---|
| Density | IP365-94 | 0.8509 g/ml @ 15° C. |
| KV 40° C. | ASTM D445-94/ASTM D446-93 | 3.149 cSt |
| Cloud point | IP 219-94 | −7° C. |
| CFPP | IP309-83 (mod.) | −16° C. |
| Sulphur | X-ray fluorescence | 0.04% mass |
| Distillation, 10% | ASTM D86-93/IP 123/93 | 229° C. |
| Distillation, 50% | ASTM D86-93/IP 123/93 | 283° C. |
| Distillation, 90% | ASTM D86-93/IP 123/93 | 331° C. |
| Cetane No. | ASTM D613-93 | 49.7 |

Example 9 (see Table 1) was prepared by adding a neutral calcium salt of the present invention into a second diesel fuel Y to achieve a concentration of 5 ppm of calcium metal. The second diesel fuel Y has the following properties:

| | Test Method | |
|---|---|---|
| Density | IP365-94 | 0.8397 g/ml @ 15° C. |
| KV 40° C. | ASTM D445-94/ASTM D446-93 | 2.619 cSt |
| Cloud point | IP 219-94 | 4° C. |
| CFPP | IP309-83 (mod.) | −19° C. |
| Sulphur | X-ray fluorescence | 0.04% mass |
| Distillation, 10% | ASTM D86-93/IP 123/93 | 201° C. |
| Distillation, 50% | ASTM D86-93/IP 123/93 | 263° C. |
| Distillation, 90% | ASTM D86-93/IP 123/93 | 340° C. |
| Cetane No. | ASTM D613-93 | 50.1 |

Description of Metal Compounds

Metal compound A: A neutral calcium sulphonate having a TBN of 16.5, a metal ratio of 1.34, and comprising colloidal calcium succinate.

Comparative Metal compound B: An overbased calcium sulphonate having a TBN of 300, a metal ratio of 13.77, and comprising colloidal calcium carbonate.

Comparative Metal compound C: Ferrocene iron dicyclopentadienyl

Description of OM366 Engine Testing Procedure

The OM366 was operated according to the procedure described below.

Procedure

1) Conditioning, run at 2600 rpm/308 Nm load on Base fuel, for 5 hours.
2) 2600 rpm/308 Nm load for 5 mins, power curve.
3) 1400 rpm/330 Nm load for 5 mins, power curve.
4) Conditioning, run at Mode "A" for 5 mins (1400 rpm/270 Nm load).
5) Carry out emissions tests at Mode "A", 20 mins.
6) Conditioning, run at Mode "B" for 5 mins (1100 rpm/240 Nm load).
7) Carry out emissions tests at Mode "B", 20 mins.
8) Conditioning, run at Mode "C" for 5 mins (2600 rpm/310 Nm load).
9) Carry out emissions tests at Mode "C", 10 mins.
10) Conditioning, run at Mode "D" for 5 mins (1400 rpm/330 Nm load).
11) Carry out emissions tests at Mode "D", 15 mins.
12) Change to additive treated fuel (Example 1 to 10).
13) Conditioning, run at 2600 rpm/308 Nm load for 2 hours, 15 mins.
14) Repeat steps 2) to 11) as above.

For Examples 1 to 8, the base fuel used was Diesel fuel X; whilst for Example 9, the base fuel used was diesel fuel Y.

After each additive treated fuel was run, the procedure started again at step 1). Thus each additive test run alternated with a base fuel run.

The level of particulate matter emission was measured during Modes A, B, C and D. The results are given in Table 1 as % difference relative to the base fuel used.

Table 1 indicates that the fuels comprising compound A provided the best reduction of particulate matter emission: compare Examples 1 and 2; Examples 3, 4 and 5; and Examples 6, 7 and 8.

Indeed, the superior particulate matter controlling properties of the fuels comprising compound A, the neutral calcium sulphonate, are apparent in each of the Modes A, B, C and D.

Further, Example 9 illustrates the particulate matter reduction effect in a second diesel fuel.

Example 10

The lubricity-enhancing effect of the salts of the invention was illustrated in the HFRR test (run at 60° C.) using metal compound A defined above at a treat-rate of 1000 ppm mass/mass of fuel. The untreated base fuel gave a wear sear diameter of 584 $\mu$m, whilst fuel treated with compound A gave a wear sear diameter of 428 $\mu$m, showing the significant reduction in wear obtainable with the salt.

TABLE 1

| Example | 1 | 2 | 3 | 4 | 5† | 6 | 7 | 8† | 9‡ |
|---|---|---|---|---|---|---|---|---|---|
| Metal Compound | A | B | A | B | C | A | B | C | A |
| ppm of Ca | 1 | 1 | 5 | 5 | 5 | 25 | 25 | 25 | 5 |
| Mode A* | −3.1 | −2.4 | −32.8 | −7.4 | +3.4 | −33.6 | −0.5 | +1.0 | −10.3 |
| Mode B* | −23.5 | −15.3 | −40.0 | −17.1 | −2.3 | −23.8 | +17.0 | +13.8 | −17.0 |
| Mode C* | −11.3 | −4.6 | −15.6 | −5.6 | −3.8 | −11.1 | −6.9 | −5.6 | −14.5 |
| Mode D* | −17.3 | −6.1 | −19.5 | −2.8 | −7.3 | −27.2 | −19.8 | +5.8 | −9.3 |

*% difference in particulate matter emission relative to base diesel fuel (for Example 1 to 8 - diesel fuel X; for Example 9 - diesel fuel Y).
†Compound C is present as ppm by weight of compound in diesel fuel.
‡Diesel fuel Y was used.

What is claimed is:

1. A process for operating a diesel engine and reducing particulate emission during combustion in the engine of a hydrocarbon middle distillate fuel composition free of transition metal compounds comprising a middle distillate fuel oil having a boiling point range of 100° C.–500° C. and a final boiling point (ASTM D-86) above 360° C. and a fuel soluble or fuel-dispersible neutral calcium and/or magnesium salt of a surfactant selected from the group consisting of sulphonic acid, phenol, sulphurised phenol, salicylic acid or carboxylic acid, said salt containing a minor amount of a non-surfactant anion selected from the group consisting of carbonate, hydroxide and succinate, and wherein:

(a) the amount of calcium and/or magnesium compounds present in the fuel composition is from 0.1 to 10 ppm by mass of metal based on the mass of the composition;

(b) the metal ratio of the calcium and/or magnesium compounds is less than 2; and (c) the fuel oil has a sulfur concentration of 0.05% by mass or less based on the mass of the fuel, comprising introducing said fuel oil into the engine and operating the engine using said fuel oil and said neutral calcium or magnesium salt being the sole particulate emissions reducing additive in the fuel oil.

2. A process according to claim 1 wherein the fuel oil is a fuel oil having a sulphur content of less than 0.03% mass, per mass of fuel, and the addition of the fuel-soluble or fuel-dispersible neutral calcium and/or magnesium salt improved the lubrication of the fuel oil.

3. The process according to claim 1, wherein the calcium and/or magnesium salt comprises a neutral calcium sulphonate.

4. The process according to claim 2, wherein the calcium and/or magnesium salt comprises a neutral calcium sulphonate.

* * * * *